United States Patent [19]

Ward

[11] 4,242,387

[45] Dec. 30, 1980

[54] WRAPAROUND DEVICE

[76] Inventor: George G. Ward, 2 Coventry La., Lincolnshire, Ill. 60015

[21] Appl. No.: 963,449

[22] Filed: Nov. 24, 1978

[51] Int. Cl.[3] ..... B32B 3/30; B32B 1/02; B32B 1/08

[52] U.S. Cl. ..... 428/35; 220/85 B; 220/85 CH; 220/85 S; 428/36; 428/167; 428/174

[58] Field of Search ..... 428/36, 35, 54, 52, 428/174, 167, 182; 138/166, 116 F, 162, 128, 118.1, 120; 220/85 B, 85 CH, 85 S; 264/274, 268, 286; 49/498, 464, 465, 492

[56] References Cited

U.S. PATENT DOCUMENTS

| | | | |
|---|---|---|---|
| 1,128,042 | 2/1915 | Pritchard et al. | 138/166 |
| 1,158,378 | 10/1915 | Fullerton et al. | 138/162 |
| 2,751,073 | 6/1956 | Sheeran | 220/85 B |
| 3,038,205 | 6/1962 | Plummer | 138/166 |
| 3,043,003 | 7/1962 | Lever | 138/166 |
| 3,161,210 | 12/1964 | Lööf | 138/166 |
| 3,347,276 | 10/1967 | Dunn | 138/166 |
| 3,503,426 | 3/1970 | MacMillan et al. | 138/168 |
| 3,654,049 | 4/1972 | Ausnit | 138/168 |
| 4,135,635 | 1/1979 | Fujii et al. | 220/85 B |

*Primary Examiner*—Paul J. Thibodeau

*Attorney, Agent, or Firm*—Hill, VanSanten, Steadman, Chiara & Simpson

[57] ABSTRACT

A wraparound device to be manipulated into tubular form and adapted to be placed in encircling relation about a member, comprises a lightweight panel construction having opposite margins which are joined when the panel is in tubular form. A locking tongue structure on one margin of the panel is adapted to be received in a locking socket structure on the other of the panel margins for retaining the panel in tubular form. The device is adapted to be made from an extruded, stamped or thermoformed thin self-sustaining resiliently flexible plastic sheet material and is constructed to be adaptable for a wide range of diametrical tube form dimensions. For snug gripping of wrapped members and to accommodate minor diameter differences the device is at least partially expansile circumferentially in the tubular form. The device is adapted to serve as a decorative and/or insulating wrap.

12 Claims, 8 Drawing Figures

Fig 5
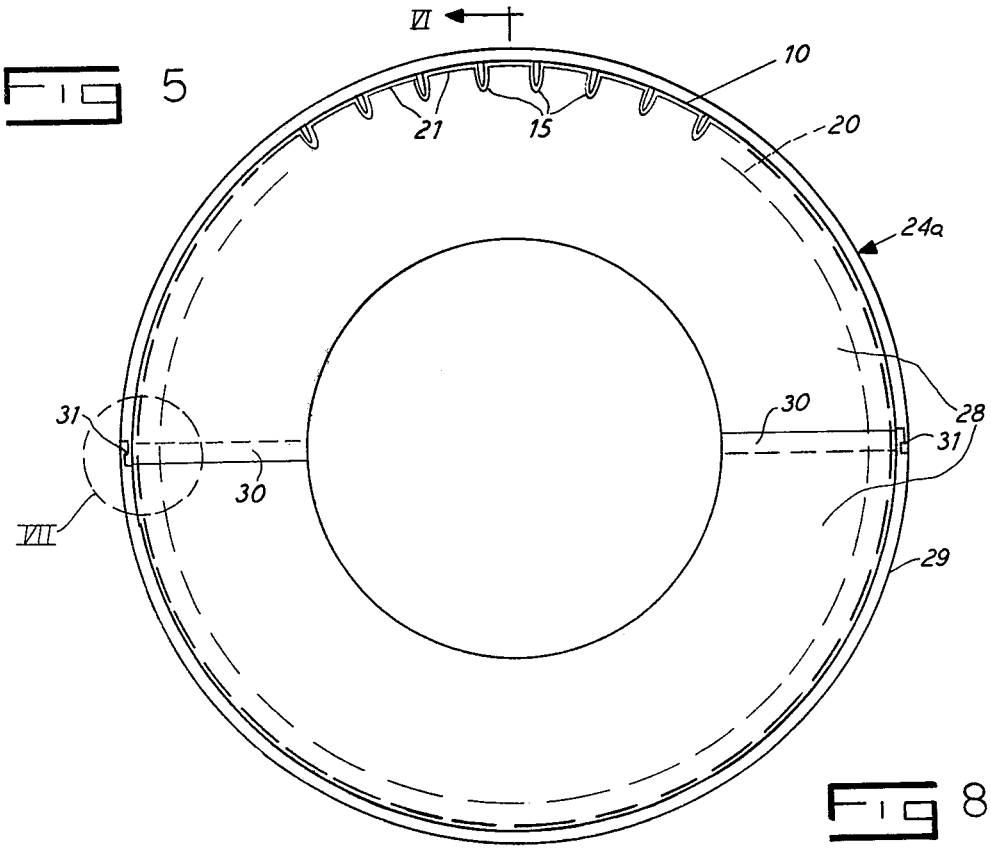
Fig 8
Fig 7
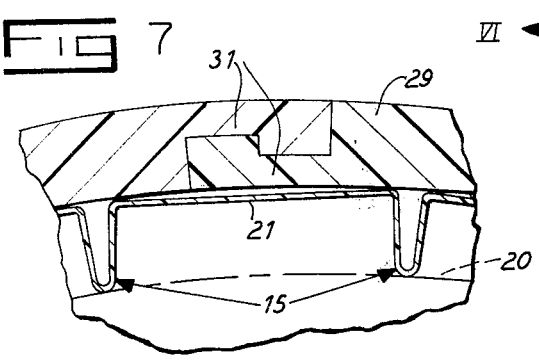
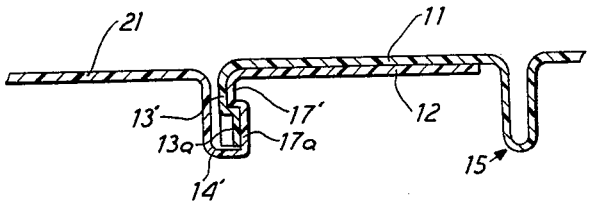
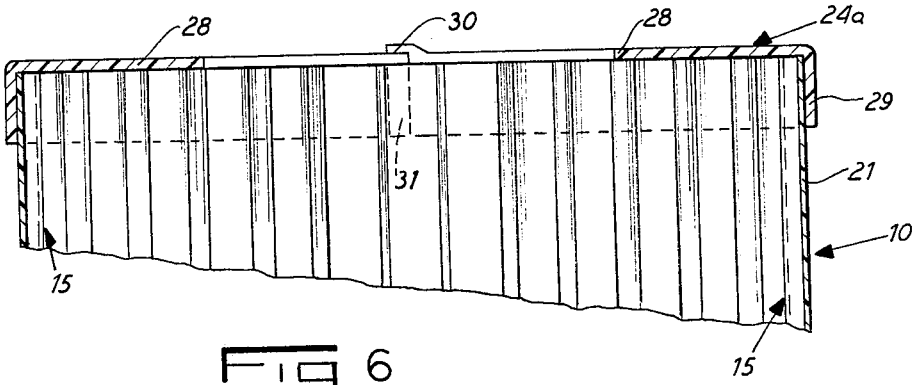
Fig 6

WRAPAROUND DEVICE

This invention relates to improvements in wraparound devices and is more particularly concerned with a device which has decorative and/or insulating capabilities.

In various and sundry situations, a tubularly formed decorative and/or insulating wraparound device can be effectively utilized. By way of example, the upright cylindrical resin tanks for domestic water softeners are often wrapped for insulating and decorative purposes by encasing the tanks in an insulating foamed plastic or fiberglass mat which may be adhered to a smooth cylindrical thermoplastic sheet having vertical margins secured by means of staples, tape or an H-shaped double channel extruded joint molding. Exposed fastening expedients present a problem of concealing the joint from view on an out of sight side of the tank. The molded joint connections require cementing to retain the ends of the sheet in the molding channels. Due to the difficulties attendant upon mounting the encasing wraps about the tanks, such wraps have customarily been pre-assembled by the water softener manufacturers who slide the tubular wraps down around the tanks. Not only does such procedure often result in ripping and separating of the wrap, where oversize tank relative to pre-assembled wrap is encountered, but there is the problem of loose wrap where the manufacturer attempts to compensate for oversize tanks by larger inside diameters of wrap in an attempt to fit all various tank sizes. Installing the wrap on a resin tank of an existing softener installation, requires some sort of joining device which is rarely available, and it is impossible to slide a preformed tubular assembly into position about the tank due to the control mechanism including plumbing attached to the tank.

There is, accordingly, a need for substantial improvement in decorative and/or insulating wrap for water softener resin tanks as is evident from the foregoing discussion. On the other hand, there are numerous and sundry situations where a wraparound device having decorative and/or insulating capabilities is desirable, such as for decorative or advertising displays, pillar encasement, large pipe wraps, column simulation, and the like.

It is accordingly an important object of the present invention to provide a new and improved wraparound device which will overcome the disadvantages, drawbacks, inefficiencies, shortcomings and problems inherent in prior constructions.

Another object of the invention is to provide a new and improved wraparound device which although it has numerous and varied uses, is especially adapted to serve as a decorative and/or insulating wrap especially suitable for resin tanks of water softeners.

An embodiment of the invention comprises a wraparound device to be manipulated into tubular form and adapted to be placed in encircling relation about a member, and comprising lightweight panel means having opposite margins which are joined when the panel is in tubular form, a locking tongue structure on one of the margins of the panel, and a locking socket structure on the other of the panel margins and lockingly receptive of the tongue structure for retaining the panel in tubular form. Desirably, the panel means comprises a thin self-sustaining flexible plastic structure which is at least partially expansile circumferentially in the tubular form whereby to be adaptable for a range of variable diametrical dimensions in members wrapped by the device.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 5 is a plan view partially in section showing an assembly according to the invention including a novel adapter cap assembly for use with the wraparound device.

FIG. 6 is a fragmentary sectional detail view taken substantially along the line VI—VI of FIG. 5;

FIG. 7 is a fragmentary enlarged sectional plan view taken substantially within the balloon VII on FIG. 5; and FIG. 8 is a fragmentary sectional detail view showing a modification.

Figure 1:
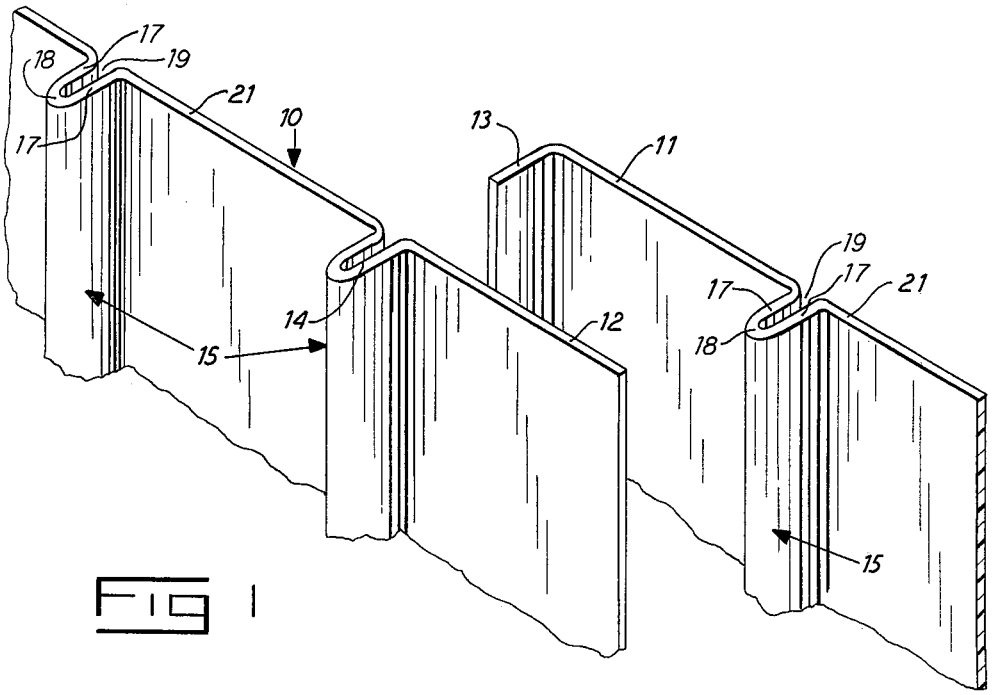
FIG. 1 is a fragmentary isometric assembly view showing opposite margins of the panel structure in position to be lockingly assembled.
Figure 2:
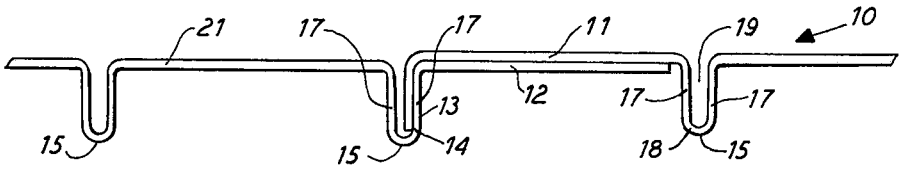
FIG. 2 is a fragmentary end elevational view showing the elements of FIG. 1 in fully assembled relation.
Figure 3:
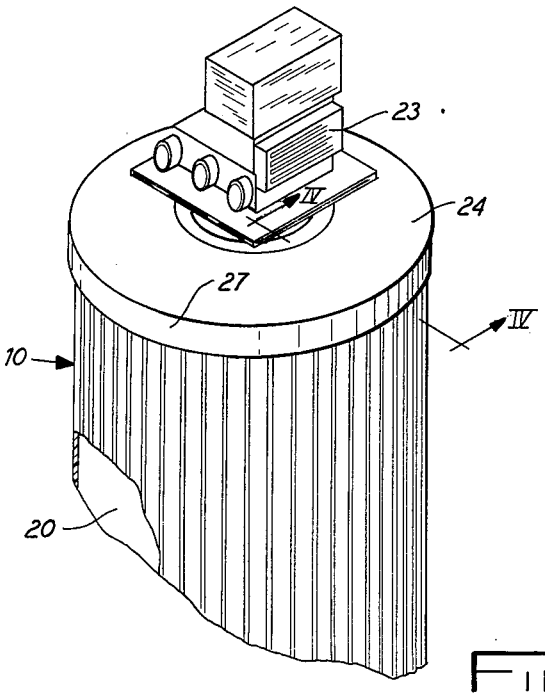
FIG. 3 is a fragmentary isometric view of the upper portion of a water softener resin tank equipped with the wraparound device of the present invention.
Figure 4:
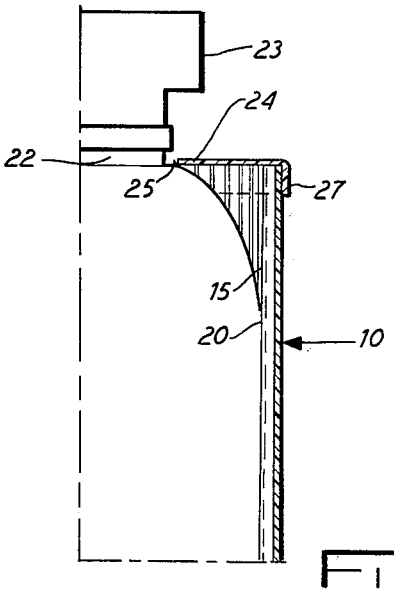
FIG. 4 is a fragmentary vertical sectional detail view taken substantially along the line IV—IV of FIG. 3.

In a practical form, a wraparound device 10 embodying the invention comprises lightweight panel means having opposite margins 11 and 12 (FIGS. 1 and 2) which are adapted to be assembled in overlapping relation. The margin which is on the outer side of the overlapping assembly has an interlock tongue structure 13 while the other of the margins has an interlock socket structure 14 which is receptive of the tongue structure 13 for retaining the panel in a tubular form. To simplify illustration in FIGS. 1 and 2, the panel portions are illustrated in flat plane, but it will be observed in FIGS. 3 and 4, for example, that the panel is illustrated in tubular form.

The panel of the device 10 is desirably thermoformed or die stamped from plastic sheet which may be cast or extruded. The material of the panel may be any suitable synthetic plastic material such as polystyrene, ABS, and the like. It may be transparent, translucent or opaque or any preferred color or combination of colors desired. In a preferred construction, self-sustaining resiliently flexible material having an original substantially common thickness throughout its extent of about 0.020 inch to 0.040 inch has been found satisfactory. Whereas the flat, unformed sheet is desirably flexibly bendable across its plane, it is resistant to yielding in its plane. For practical reasons, however, the panels should be at least partially expansile circumferentially when the panel has been manipulated into tubular form, whereby to adapt the device for a range of variable diametrical dimensions in members wrapped by the device. Further, in the tubular form, the device should be resistent to deformation in its axial dimension and also resistent to deformation in a direction normal to the tube axis. All of these desirable characteristics are attained by providing the panel with parallel ribs 15 which extend longitudinally in the tubular form and are transversely resiliently yieldable. In a desirable arrangement, the ribs 15 extend inwardly on the panel of the device 10 at preferably regularly spaced intervals parallel to one another and parallel to the tongue 13 which is conveniently formed as a continuous flange or fin 13 along the edge of the margin 11.

Each of the ribs 15 is constructed as an integral return bent formation of suitable depth having opposite side walls 17 and an inner end juncture 18 joining the side walls 17. Between the side walls 17 is an outwardly opening groove 19 which is desirably slightly greater in width than the thickness of the fin 13. In a practical form where the device 10 is to serve as a wrap for a water softener resin tank 20, (FIGS. 3 and 4), the ribs 15 may be of about 3/16 to 5/16 inch in the overall depth dimension and with webs 21 between the ribs 15 about ½ to 1 inch wide. Due to thermoforming or stamping operation, the thickness of the fin 13 and the thickness of the rib walls 17 will be slightly less than the original thickness of the plastic sheet material.

By having the tongue fin 13 of a width which is no greater than, and preferably slightly less than, the depth of the rib grooves 19, the socket structure 14 may be and desirably is the rib 15 contiguous to the margin 12 within the groove of which the fin 13 is thus readily frictionally engaged. As will be observed in FIG. 2, when the fin 13 is received in the socket 14, and the flanges 11 and 12 lappingly engaged, the joint will be virtually undetectable without the closest scrutiny and will thus contribute rather than detract from the symmetry of appearance of the tubular wrap. Contributing to the relationship is the dimension of the outer margin 11 especially in its width equivalent to the width of the intermediate web panel sections 21. However, the inner margin 12 should be narrower than the margin 11 sufficient to be freely accepted between the fin 13 and the nearest rib 15 joined to the margin 11. For this purpose, the margin 12 should be narrower than the margin 11 by at least twice the thickness of the material of the panel.

For use, the device 10 may be manipulated from a substantially flat planar panel shape into tubular form by bending the panel to bring the margins 11 and 12 into lapping laminar relation and inserting the fin 13 into the socket 14, whereby the ribs 15 are at the inside of the tube and the outside of the tube provides a pleasing substantially cylindrical longitudinally striped appearance. The tube may be utilized in its hollow form as a decorative column such as may be useful in a decorative display or merchandise display, or the like. On the other hand, a prime utility of the device is as a decorative and/or insulating wrap about a member such as the water softener resin tank 20. If, after the device 10 has been locked in its tubular form, it is desired to assure permanence and avoid separation of the locking fin 13 from the socket 14, suitable means such as cementing material may be applied to the fin 13 for permanently securing the fin to the walls 17 of the rib 15 providing the socket 14.

Where a positive interlock of the locking fin and socket structure is desired, the arrangement shown in FIG. 8 may be employed, wherein the locking fin 13' has on its distal margin one or more and preferably a plurality, of interlock projection means **13*a* engageable in corresponding complementary interlock recess means 17*a* in the wall 17' of the socket 14' which joins the terminal panel 12. For example, in a tube length of about 35 to 45 inches in the device, there may be three of the interlocks 13*a*, 17*a* located on the fin 13' and on the socket wall 17' adjacent to each end, and another set of the interlocks 13*a*, 17*a* located at an intermediate point such as at the center of the length. The interlock projection are preferably molded in the fin 13' and the wall 17' in the process of forming the device. As shown, the interlock offset or projection 13*a* may be about ½ the width of the fin 13' and the interlock socket recess 17*a* of corresponding width. In length, the interlock projection 13*a* and the recess 17*a* may be about ¾ inch in a typical construction. By virtue of the resiliency of the material of the device, the interlock projections 13*a* can be forced into interlocked relation in the socket recesses 17*a* by pressing the fins 13*a* into the socket 14' until the interlock offset shoulder projections 13*a* snap into the offset interlock sockets 17*a*. In this relationship the fin 13' will be held positively in the socket 14' even under substantial tension or stress tending to pull the fin 13' from the socket 14', and permits a more severe circumferential tension or stress condition than where merely frictional interengagement of the fin within the socket is relied on. This arrangement is also useful where the device may be employed by itself as a decorative tube and there is not enough circumferential tension to maintain a satisfactory frictional retention of the fin within the interlock socket, so that the positive latching interlock of the interlock projections 13*a* within the socket recesses 17*a* will be useful in maintaining the interlocked relationship. By virtue of the resiliency of the material, when it is desired to disassemble the device to return it to substantial the flat condition for storage, the fin 13' can be manipulated relative to the socket 14' to disengage the interlocks 13*a* from the socket recesses 17*a***.

Where the device 10 is applied as an encircling cover about the water softener resin tank 20 (FIGS. 3 and 4), the device is dimensioned as to length and tube diameter to extend from the base on which the tank is mounted to the top of the tank, with the upper end of the device 10 at about the same elevation as the lower end of a neck 22 which is usual on such tanks and on which may be supported control mechanism 23 for the water softner. Then, to complete the enclosure, a cap 24 having a central opening 25 to clear the neck 22 and a depending outer peripheral flange 27 is applied to the top of the tubular device 10. This has the effect of not only providing a finished appearance for the top of the device and thus for the top of the tank, but also advantageously encloses a dead air space within the device 10 about the tank 20 providing desirable insulating value. For this purpose, the ribs 15 serve as spacers to maintain the device 10 in substantially uniformly spaced relation about the tank 20. Since the plastic material from which the device 10 is constructed has low thermoconductivity, and the ribs make only line contact with the tank 20 while the remainder of the device 10 is held in substantially spaced relation to the tank wall, efficient thermal insulation is provided about the tank wall without need for any other insulating material.

In order to permit the device 10 to be applied to an existing water softner resin tank 20, for example, without necessitating dismantling of the control apparatus 23 from the top of the tank, a multi-part adapter cap **24*a* (FIGS. 5, 6, and 7) is provided. This cap comprises in a desirable form, a two part crown panel 28 split diametrically into two parts and on which a depending skirt flange 29 is similarly split. Along the longitudinal split in the crown panel 28, a slip-type lap shoulder joint 30 is provided. Each half of the skirt flange 29 has on its opposite ends complementary resilient tongue and groove interlock means 31. Through this arrangement, after the device 10** has been wrapped around the tank 20, the cap 24*a* is adapted to be applied by bringing the separated halves thereof into edge-to-edge relation wherein the slip joint 30 is brought into assembled relation and the resilient interlocks 31 snapped together, thereby retaining the cap in place. In the assembled relationship, the slip joint 30 and the interlocks 31 provide sufficiently tight seam for the cap 24*a* to maintain an efficient dead air space relationship within the wraparound device enclosure.

For maximum efficiency, the inner edges of the ribs 15 of the device 10 should engage reasonably firmly with the wall of the tank 20 or other member encircled by the device. For this purpose, the width of the one piece panel forming the device 10 as measured from the fin 13 to the socket 14 should be slightly less by 1% to 3% relative to the circumference to be engaged by the device. Then when the device is wrapped about the object, i.e. the tank 20, the hollow tubular panel structure is tensioned sufficiently, as permitted by its expansile, i.e. stretchability, capability to maintain frictional interlock of the interlock tongue fin 13 within the interlock socket 14 where the plan form of finsocket structure is employed. Resilient yieldability for this purpose is attained in part in the device 10 by the ability of the intermediate web sections 21 to assume an arcuate transverse configuration when the panel of the device 10 is bent into tubular form without circumferential stretching. Then, when the inner edges of the ribs 15 engage the encircled object, pulling of the margins 11 and 12 toward one another causes limited circumferential stretching of the device by pulling in of the web sections 21 toward a generally straight across planar condition. Greater circumferential stretching of the tubular panel of the device 10 to accommodate the encircled object, is effected by the ribs 15 serving as resilient expansion hinges by spreading open uniformly about the circumference to the extent necessary. In FIG. 7, exaggerated expansion is depicted. Where such expansion may have to be anticipated, the positive latching or interlock device shown in FIG. 8 may be found useful.

Where the simple form of interlock fin and socket is used, the tension under which the tubularly formed panel of the device 10 is placed about the circular object, e.g. the tank 20, frictional grip of the interlock fin 13 with the walls in the interlock socket 14 will be relied on to retain a firm interlocked relationship to hold the panel against separation. To the attainment of this result, the resilience of the panel structure of the device should be calculated to permit bending and wrapping of the preformed panel from a substantially flat condition into the tubular shape about the article to be wrapped and with sufficient circumferential tension to maintain the interlock fin 13 interlocked within the groove 14 to not only maintain the device firmly in place on the wrapped member but also to oppose the latent force or memory factor of the wrap to return to its originally generally flat state. Of course, the interlock fin 13 and the structure of the socket 14 must be of sufficient strength, i.e. stiffness, to withstand the stress placed upon these structures by the circumferential tension. It may be noted, that resilient flexibility of the device 10 is a function of material thickness, hinge action of the radii of the groove rib 15 at the juncture 18 and at the juncture of the walls 17 with the web sections 21, and the number of the ribs 15 relative to a given circumferential extent of the tubular wrap device 10. Circumferential tension is a function of the diameter of the member about which the wrap device 10 is wrapped, relative to the circumferential width of the wrap as measured from the fin 13 to the socket 14, assuming the device to be substantially constant in such respects as stiffness, number of ribs, and the like. Stiffness of the interlock fin 13 is a function of the fin material wall thickness and the severity of the juncture radius where the fin meets the flange 11. All of the ribs 15, the grooves 19, and web thickness will have substantially the same relation throughout the device 10 by reason of the method of construction starting with a sheet of material which has a substantially uniform wall thickness throughout.

By preference, the radius of the juncture of the interlock fin 13 with the margin 11 may be controlled to have a larger radius than, for example, the juncture radius of the rib walls with the sections 21. This imparts a less hinge type flexibility at the fin-margin radius and thus greater stiffness of the interlock fin construction.

An important advantage of the device 10 employing the simple fin and socket arrangement is that a standardized construction can be adapted for a substantial range of tube diameter and tube lengths. The tube length and diameter dimensions of the initial sheet, whether it be thermoformed, stamped or extruded can be predetermined, and the preformed sheet trimmed to any production requirements for sizes less than the maximum size for which the sheet as constructed is adapted. In this connection, it may be noted that any one of the ribs 15 may serve as the socket 14. Although the sheet as initially made may have the margin 12 at the opposite side from the margin 11, and thus meet the maximum tube diameter requirements, smaller diameter requirements can be accommodated by trimming back at the margin 12 side of the sheet to trim away one or more of the ribs 15, with the remaining marginal section 21 becoming the margin 12. For example, for wrapping the water softener tank 20 the device 10 may be initially constructed to fit the largest size tank, e.g. about ten inches in diameter, but when the requirement is to wrap a smaller diameter tank, one or more of the ribs 15 can be trimmed away to accommodate the required tank diameter. To the same effect, where it is desired to utilize the device 10 for merely decorative column purposes, a wide range of tubular column diameters can be attained.

Also of considerable advantage is the fact that the device 10 can be easily handled, stored and shipped in a flat state piled one on the other and thus easily palletized for convenience in handling. If preferred, of course, the device may be rolled up into a small roll where only one or a few of the devices must be handled for transportation to point of use. In any event, the device may be fabricated in shop or factory and shipped out to the points of use such as water softner assemblers, manufacturers, decorative designers, etc.

It will be understood that variations and modifications may be effected without departing from the spirit and scope of the novel concepts of this invention.

I claim as my invention:

1. A wraparound device to be manipulated into tubular form and adapted to be placed in encircling relation about a member, and comprising:

lightweight panel means of a thin self-sustaining plastic material which has a substantially common thickness throughout its extent and is resiliently flexible across its plane so that the panel means can be bent into tubular form to bring opposite margins of the panel means together;

said panel means having at predetermined spaced intervals and extending entirely thereacross, between and generally parallel to said margins, a plurality of narrow reinforcing ribs comprising indentations projecting from one face of said panel means and running out freely at opposite edges of said panel means and which edges extend between and normal to said margins;

said ribs having walls defining narrow slot-like grooves which open from the opposite face of the panel means throughout the length of the ribs and the grooves having open ends at said edges;

said ribs serving as resilient expansion hinges by spreading open and permitting resilient expansion flexibility in direction across said ribs and between said margins, so that the ribbed panel means throughout its extent is rendered partially expansile circumferentially in the tubular form, even though the material of the panel means is of itself resistant to yielding in its plane, whereby the tubular form of the panel means is adaptable for a range of variable diametrical dimensions in members wrapped by the device;

and means for securing said margins together for maintaining said panel means in tubular form.

2. A wraparound device according to claim 1, wherein said means for securing comprise a tongue flange on one of said margins extending in the same direction as said ribs, the rib walls providing opposing sides of substantial width and joined by relatively narrow respective junctures, whereby said grooves between said wall sides are adapted for receiving said tongue flange interlocking relation.

3. A wraparound device according to claim 1, wherein said ribs are located at substantially uniform intervals, and web sections of continuous width extend between and space said ribs apart.

4. A wraparound device according to claim 3, wherein the web sections at said margins are in overlapping relation in the tubular form of the device.

5. A wraparound device according to claim 1, in combination with an upright water softener resin tank encircled by the device in tubular form, said ribs engaging said tank and maintaining the panel means otherwise in dead air space spaced relation about the tank, and a cap on the upper end of the wraparound device having a depending annular flange about said upper end, the cap closing said groove ends and the dead air space between the device and the tank, whereby to maintain an insulative as well as decorative covering about the tank.

6. A combination according to claim 5, wherein said cap comprises split portions adapting the cap to be mounted in place by manuevering the split portions laterally into position, and means retaining the split portions of the cap in assembly with one another and in the cap form on the device and the tank.

7. A wraparound device according to claim 1, wherein said means for securing comprises a flange extending from one of said margins in the same direction as said ribs, one of said ribs being located adjacent to the other of said margins and said flange being engageable in the groove of such rib, and width of such groove and the thickness of the flange being complementary to receive the flange closely within such groove, and means retaining said flange in such groove.

8. A wraparound device according to claim 7, wherein said means for retaining said flange in such groove comprise interlocking detent and socket structure located along the length of said flange and such groove.

9. A wraparound device to be manipulated into tubular form and adapted to be placed in encircling relation about a member, and comprising:

a lightweight thin self-sustaining plastic panel of a material which has a substantially common thickness of about 0.020 to 0.040 inch through the extent of the panel and is resiliently flexible across its plane so that the panel can be bent into tubular form;

said panel having opposite margins which are adapted to be brought together in the tubular form of the panel;

means along said opposite margins for securing the panel from a substantially flat condition into tubular form;

said panel having at predetermned spaced intervals and extending entirely thereacross between and parallel to said margins a plurality of ribs comprising indentations projecting from the face of the panel which is at the inside in the tubular form and said ribs having walls defining grooves of substantial depth which open from the face of the panel which is at the outside of the tubular form, and the grooves extending throughout the length of the ribs and having open ends at opposite edges of said panel and which edges extend between and normal to said margins;

and the ribs serving as resilient expansion hinges by spreading open and affording resilient flexibility in direction across said ribs and between said margins, so that the ribbed panel is at least partially expansile in direction across said ribs and between said margins throughout the extent of the panel in the tubular form, whereby to be adaptable for a range of variable diametrical dimensions in members wrapped by the device, even though the material of the panel is of itself resistant to yielding in its plane.

10. A wraparound device according to claim 9, wherein said margins are in overlapping relation in the tubular form, the outer of said margins having a locking tongue flange fin therealong which extends in the same direction as said ribs, and one of said ribs being contiguous to the inner of said margins and the groove of such rib providing a socket within which said tongue flange fin is lockingly received.

11. A wraparound device according to claim 10, including means for securing said tongue flange fin in said groove socket.

12. A wraparound device according to claim 11, wherein said securing means comprise a plurality of snap-in interlock detents and socket structure at spaced intervals along the length of said tongue flange fin and the groove socket in which the tongue flange fin is received.

* * * * *